US010912369B2

(12) United States Patent
Presche

(10) Patent No.: US 10,912,369 B2
(45) Date of Patent: Feb. 9, 2021

(54) DEVICE FOR APPLYING A TRANSFERABLE SUBSTANCE

(71) Applicant: RPC Bramlage GmbH, Lohne (DE)

(72) Inventor: Martin Presche, Dinklage (DE)

(73) Assignee: RPC Bramlage GmbH, Lohne (DE)

( * ) Notice: Subject to any disclaimer, the term of this patent is extended or adjusted under 35 U.S.C. 154(b) by 31 days.

(21) Appl. No.: 16/331,356

(22) PCT Filed: Aug. 9, 2017

(86) PCT No.: PCT/EP2017/070192
§ 371 (c)(1),
(2) Date: Mar. 22, 2019

(87) PCT Pub. No.: WO2018/041566
PCT Pub. Date: Mar. 8, 2018

(65) Prior Publication Data

US 2019/0357657 A1 Nov. 28, 2019

(30) Foreign Application Priority Data

Aug. 30, 2016 (DE) ..... 10 2016 116 134

(51) Int. Cl.
*A45D 40/06* (2006.01)
*A45D 40/00* (2006.01)

(52) U.S. Cl.
CPC ..... *A45D 40/06* (2013.01); *A45D 40/065* (2013.01); *A45D 2040/0025* (2013.01)

(58) Field of Classification Search
CPC ..... A45D 40/06; A45D 40/065; A45D 40/12; A45D 40/20; A45D 40/205; A45D 40/02;
(Continued)

(56) References Cited

U.S. PATENT DOCUMENTS 2,071,747 A 2/1937 Houlihan
3,308,939 A 3/1967 Sakalys
(Continued)

FOREIGN PATENT DOCUMENTS

EP 2 220 960 A1 8/2010
FR 2 869 772 A1 11/2005

OTHER PUBLICATIONS

International Search Report of PCT/EP2017/070192, dated Nov. 6, 2017.

*Primary Examiner* — David J Walczak
(74) *Attorney, Agent, or Firm* — Collard & Roe, P.C.

(57) ABSTRACT

A device for applying a transferable substance in stick form, has a substance carrier and a protective sheath for the substance carrier, wherein the substance carrier can be shifted relative to the protective sheath in order for a free end region of the substance to be shifted into a free, projecting position, and also having a protective cap for covering the free end region of the substance in a not-in-use state. The protective sheath and the protective cap are accommodated in a casing part and the protective cap and the protective sheath is displaceable in a displacement direction in the casing part. The casing part has through-passage openings at its opposite ends, as seen in the displacement direction, and the protective cap is connected to the casing part such that it is movable in the displacement direction, but is captive.

8 Claims, 5 Drawing Sheets

(58) Field of Classification Search
CPC ..... A45D 40/023; A45D 2040/00; A45D 2040/0006; A45D 2040/0025; A45D 2040/0031; A45D 2040/0037; A45D 2040/0062; A45D 2040/204
See application file for complete search history.

(56) References Cited

U.S. PATENT DOCUMENTS

| | | | | |
|---|---|---|---|---|
| 7,874,753 | B2 * | 1/2011 | Domy | A45D 40/10 206/385 |
| 8,353,636 | B2 * | 1/2013 | Drugeon | A45D 40/10 401/107 |
| 8,734,041 | B2 * | 5/2014 | Hermouet | A45C 11/008 401/98 |
| 9,004,795 | B2 * | 4/2015 | Salciarini | A45D 40/10 401/99 |
| 2006/0285911 | A1 * | 12/2006 | Demellier | A45D 40/10 401/75 |

* cited by examiner

DEVICE FOR APPLYING A TRANSFERABLE SUBSTANCE

CROSS REFERENCE TO RELATED APPLICATIONS

This application is the National Stage of PCT/EP2017/070192 filed on Aug. 9, 2017, which claims priority under 35 U.S.C. § 119 of German Application No. 10 2016 116 134.9 filed on Aug. 30, 2016, the disclosure of which is incorporated by reference. The international application under PCT article 21(2) was not published in English.

FIELD OF TECHNOLOGY

The invention relates to a device for applying a transferable substance in stick form, with a substance carrier and a protective sheath for the substance carrier, wherein the substance carrier can be shifted relative to the protective sheath in order to shift a free end region of the substance into a free, projecting position, and further with a protective cap for covering the free end region of the substance in a non-use state.

PRIOR ART

Devices of the kind in question are known, for example in the form of sticks, which have a transferable substance, for example transferable through friction. For example, such sticks are further known as lipsticks, but also as sticks for applying care products, in particular skincare products, or for applying medical products.

Reference is further made to U.S. Pat. No. 3,308,939, for example. This patent specification discloses a device of the kind in question, in which the free end region of the substance can be shifted into a free, projecting position by turning the substance carrier that carries the substance relative to the protective sheath. Known from U.S. Pat. No. 2,071,747 is a device in which such a shifting of the free end region due to a linear shifting displacement of the substance carrier relative to the protective sheath takes place along a longitudinal axis of the device.

It is also known to cover the free end of the substance with a protective cap in the non-use state of the device.

SUMMARY OF THE INVENTION

With respect to known prior art, one technical problem of the invention is regarded as further improving a device of the kind in question, in particular as relates to handling the device.

Based on a first inventive idea, one possible solution to the task for a device emphasizes that the protective sheath and protective cap be accommodated in a casing part and that the protective cap and protective sheath can be shifted in a displacement direction in the casing part, that the casing part have passage openings at its opposite ends as viewed in the displacement direction, and that the protective cap be connected with casing part so that it can move in the displacement direction, but is captive.

In a preferred embodiment, the casing part overlapping the protective sheath in the non-use state simultaneously carries the protective cap that covers the substance in the non-use state. The latter is preferably held in the casing part so that it can be displaced in the extension direction of a longitudinal axis of the casing part. As also preferred, the displaceability can be limited by stops in both directions. In any event, the protective cap is held on the casing part in a captive manner.

The protective sheath, and hence preferably the device part having the substance, can also be shifted along the same displacement axis as that of the protective cap relative to the casing part. The device part having the protective sheath and substance is preferably removed by such a shifting displacement relative to the casing part.

In the non-use position of the device overlapped by the casing part, a free peripheral edge of the protective cap that faces inwardly relative to the casing part can be supported on an allocated free peripheral edge of the protective sheath, so that a shifting displacement of the protective cap along the longitudinal axis of the casing part leads to a corresponding shifting displacement of the protective sheath, and hence of the device part that has the substance. As a result, displacing the protective cap relative to the casing part makes it possible to move the protective sheath, and hence the device part that has the substance, into a position relative to the casing part from. Which the device part that has the substance can be completely removed from the casing part, or such a removal can be enabled or simplified for the user.

Additional features of the invention are described below, to include the description of the figures, often in their preferred allocation to the claim concept already explained above. However, they can also be of importance as allocated to only one or several individual features, as described here, in particular of the claims already dealt with, or even independently or in some other overall concept. The measures in the discussed claims can also be combined with each other.

Another embodiment can provide that a combined length of the protective sheath connected with the protective cap be larger than the length of the casing part in the shifting direction. Depending on the shifting position, a portion of the protective cap and/or a portion of the protective sheath can project over the casing part as viewed in the longitudinal extension of the casing part, in particular for activating the shifting of the protective cap and/or to engage the protective sheath. For example, the combined length of the protective cap and protective sheath can correspond to 1.05 to 1.2 times the length of the casing part viewed in the same direction.

The casing part can be designed like a cylinder, for example further, as also preferred, like a cylinder with a circular cross section.

The through openings of the casing part opposite each other in the displacement direction, further preferably in the direction of longitudinal extension of the casing part, can have the same opening cross sections. In a preferred embodiment, the selected opening cross section, further in particular the opening diameter of a passage opening, is smaller than the measure of the opposing passage opening. The passage opening with a smaller diameter is preferably allocated to the protective cap.

In another preferred embodiment, the protective sheath can have a moving part for the substance. The moving part can, as also preferred, act on the substance carrier, wherein the substance carrier can be guided like a piston into the protective sheath along the longitudinal axis of the protective sheath, for example.

The protective sheath can also have a peripheral enlargement over a portion of its length for a frictional interaction with an inner surface of the casing part. The peripheral enlargement can here arise completely over the entire periphery of a partial region of a protective sheath. In a preferred embodiment, isolated peripheral enlargements are distributed over the periphery, for example in the form of radial projections. These provide a frictional mounting of the protective sheath, and hence the device part that has the substance, in the casing part. The frictional force must be overcome when displacing the protective cap for shifting the protective sheath into a removal position.

The peripheral enlargement can be formed on the moving part, and thus preferably in an end region opposite the outlet end of the protective sheath for the substance.

In an alternative embodiment, the protective cap can be held so that it can be displaced through exposure to a spring force in the casing part, wherein the spring force loads the protective cap in a basic position that axially projects over the allocated end of the casing part. Such a spring part can be a separate part, for example in the form of a cylinder compression spring. The spring force can also result from an elastic restoring force of the used material of the interacting sections of the protective cap and/or casing part.

BRIEF DESCRIPTION OF THE DRAWINGS

The invention will be explained in more detail below based on the attached drawing, which only presents an exemplary embodiment. Shown on:

FIG. 4 is the section according to line IV-IV on. FIG. 2;

FIG. 7 is a magnified view of region VII on. FIG. 6;

DESCRIPTION OF THE EMBODIMENTS

Figure 1:
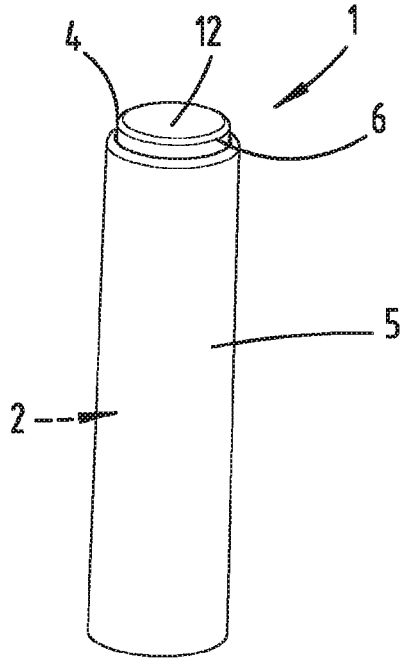
FIG. 1 is a perspective view of a device of the kind in question, as relates to the non-use state.

Shown and described initially with reference to FIG. 1 is a device 1, for example in the form of a lipstick.

The device 1 has a device part 2 for applying a substance 3, as well as a casing part 5 having a protective cap 4.

As shown, the device 1 can be formed as a rotationally cylindrical cylinder overall.

Accordingly, the casing part 5 is preferably designed as an elongated hollow cylinder with a circular contour, with a longitudinal extension along a rotational axis x that corresponds to roughly 4 to 5 times the outer diameter of the casing part 5 uniformly selected over the length of the latter.

All parts of the device 1 are preferably made out of a plastic, in particular a hard plastic, further for example each fabricated in a plastic injection process.

The casing part 5 correspondingly has passage openings 6 and 7 at the ends opposite each other in the direction of extension of the rotational axis x. The opening diameter of the passage opening 7 can correspond to the inner diameter of the casing part 5, as is also preferred.

By contrast, the diameter of the opposing passage opening 6 is diminished relative to the inner diameter of the casing part 5, for example by about. 1 to 2 times the material thickness of the casing part wall 8. This yields an inwardly facing collar 9 in the region of the passage opening 6.

The protective cap 4 penetrates through the passage opening 6, and is held in the casing part 5 in a captive manner so that it can be shifted along the rotational axis x.

The protective cap 4 is pot-shaped in design, with a continuous cap wall 10 and a cap cover 11, which outwardly directed provides an activating surface 12 when essentially aligned transversely to the rotational axis x.

Over the largest portion of the axial longitudinal extension of the protective cap 4, in the exemplary embodiment shown over about two thirds of this length, the cap wall 10 is adjusted in terms of its outer diameter to a region. 13 that adjoins the collar 9 on the interior of the casing part 5 and has an enlarged inner diameter.

Viewed in the axial direction, this region with an enlarged diameter 13 extends over about one fifth of the overall length of the casing part 5.

The diameter-adjusted section of the cap wall 10 extends in an axial direction over a distance corresponding to about 0.5 to 0.75 times the axial extension of the region 13.

The diameter-adjusted region of the cap wall 10 described above transitions into a reduced-diameter section, which relative to the outer diameter is adjusted to the free diameter of the passage opening 6 encompassed by the collar 9. The cap section passing through the passage opening 6 carries the cap cover 11 on its end.

Obtained at the transition from the larger-diameter section diameter to the diminished-diameter section of the protective cap 4 is a continuous shoulder 14, which in a basic position preferably corresponding to the non-use position of the device 1 pushes against the collar 9 inside of the casing part 5 in a stop limiting manner.

A free annular end face of the cap wall 10 that faces away from the cap cover 11 and plunges into the casing part 5 is in this position spaced apart in an axial direction from a stop shoulder 15 that arises at the transition from the diameter-expanded region 13 into the remaining inner wall region of the casing part wall 8.

Viewed in its peripheral direction, the cap wall 10 is divided into individual sections by slotted cutouts 16 running in the axial direction, in particular in order to simplify assembly. During assembly, these can elastically deflect radially inward, and swing back into their original position due to the elastic restorability they preferably have.

As depicted, the protective cap 4 and casing part 5 can consist of two separately fabricated components. Alternatively, the latter can also be fabricated in a two-component injection molding process as an injection assembly mold.

The device part 2 essential y consists a substance carrier 17 that acts like a piston, and a protective sheath 18 that has a moving part 19 and a counter-holder cylinder 27.

The moving part. 19 is essentially circular cylindrical in design overall, and has a pot-shaped handling section 20. The latter extends over about one third of the entire axial length of the moving part 19 or protective sheath 18 as a whole.

In particular the handling section 20 can be completely closed peripherally and, if necessary, also in relation to the pot bottom-like end face.

Proceeding from the continuous edge of the wall of the handling section. 20, a sheath section 21 of the moving part 19 follows in the further extension along the axis. The latter is connected with the handling section 20 in a torque-proof manner.

The piston-like substance carrier 17 is guided in this sheath section 21. The transferable substance 3 sits on the carrier floor 22 of the substance carrier 17 as a kind of transfer stick.

The substance carrier 17 can be used to bring the substance 3 or a free end of the substance 3 into a projecting position over the free end of the moving part 19.

The sheath section. 21 is adjusted in terms of its inner diameter to the inner diameter of the adjoining handling section. 20, so that the substance carrier 17 can move peripherally supported in every axial position, preferably over the entire inner length of the moving part 19.

By contrast, the outer diameter of the sheath section. 21 is reduced in relation to the outer diameter of the handling section 20, roughly by half the material thickness of the wall.

The counter-holder cylinder 27 is arranged in this region that radially outwardly envelops the sheath section 21. The latter is adjusted to the sheath section. 21 with respect to the axial length and inner diameter. The outer diameter preferably corresponds to that of the handling section 20.

The moving part 19 can be rotated around the rotational axis x relative to the counter-holder cylinder 27.

Conventional handling involves the user gripping the counter-holder cylinder 27 and initiating a piston displacement by turning the moving part 19.

In order to make it linearly displaceable, the substance carrier 17 can be provided on the exterior wall side of its continuous wall with two diametrically opposed, radially projecting pins 23. These plunge through correspondingly positioned longitudinal slits 24 of the sheath section 21 that run in the direction of extension of the rotational axis x, and helically engage into control grooves 25 that extend around the rotational axis x and are provided on the interior wall side of the counter-holder cylinder 27.

Accordingly, the substance carrier 17 is linearly displaced along the rotational axis x given a rotational activation of the moving part 19, during which any rotation by the latter around this axis is prevented. The moving part 19 can be rotationally moved to bring the substance 3 into a desired projecting position whale using the device part 2.

Figure 2:
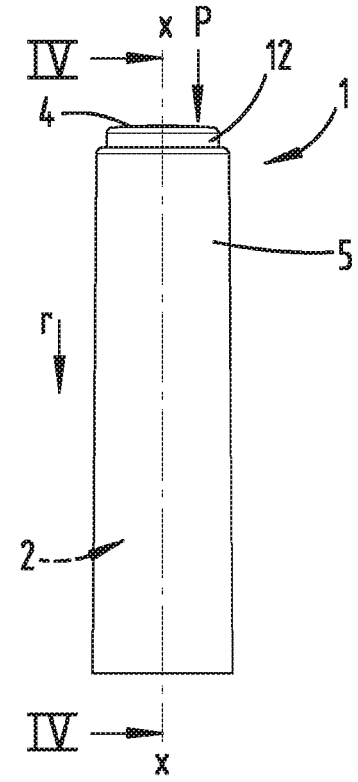
FIG. 2 is a view representation of the above.
Figure 3:
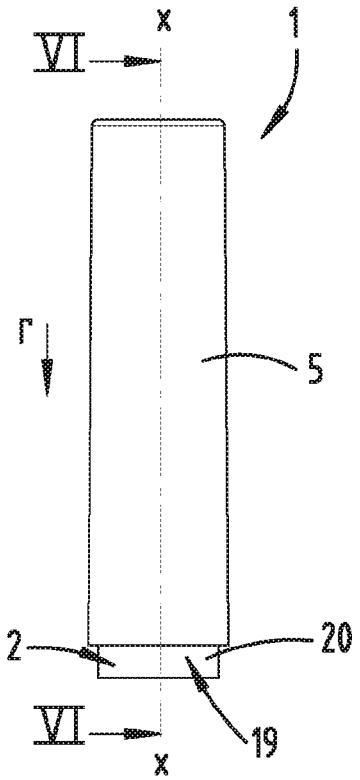
FIG. 3 is an illustration corresponding to FIG. 2, as relates to a device part having a substance in the removal position.
Figure 4:
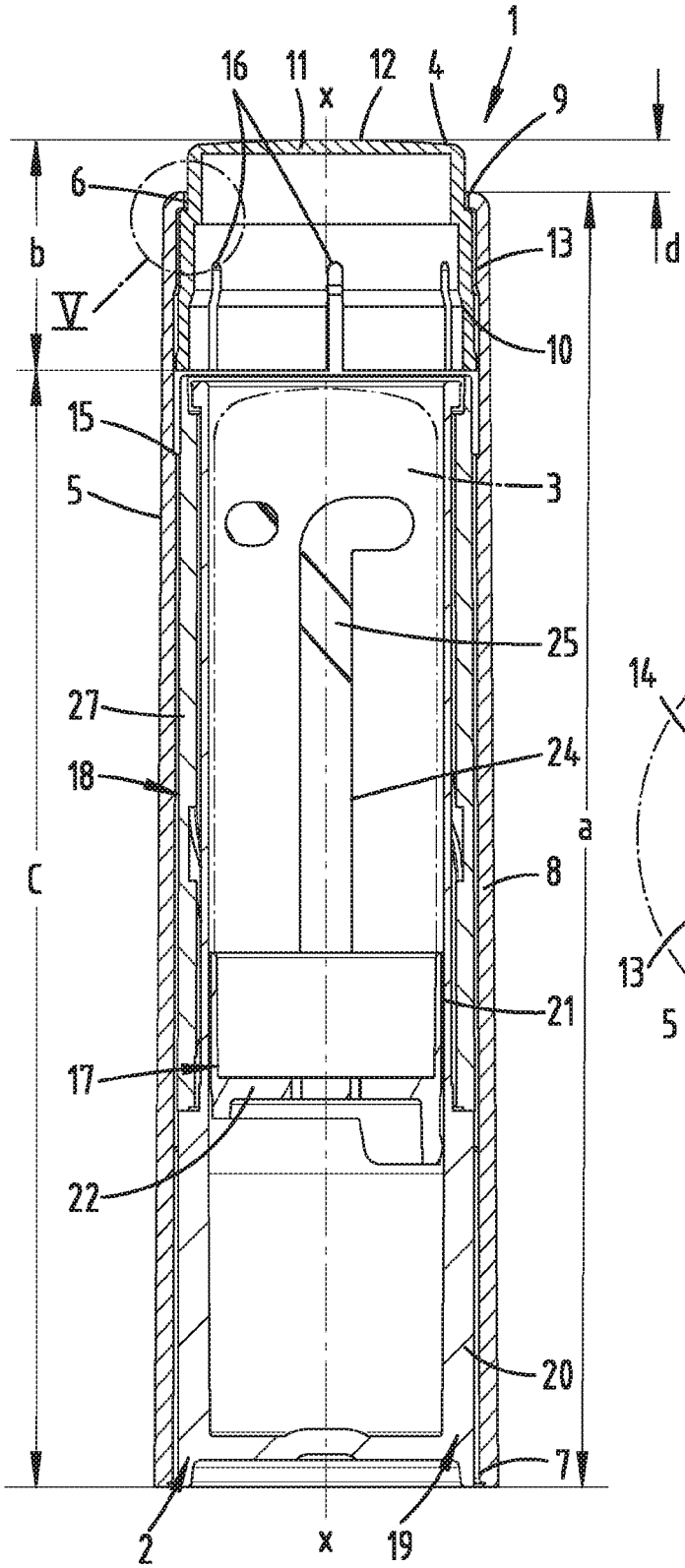
Figure 5:
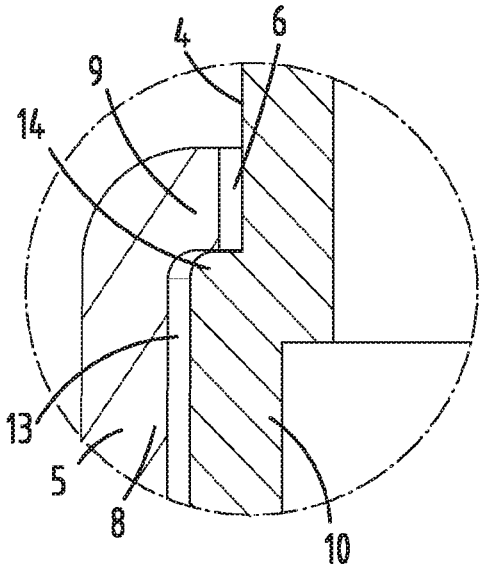
FIG. 5 is a magnified view of region V on FIG. 4.

In the non-use position, for example according to FIGS. 1 to 2 and 4, the device part 2 is completely accommodated in the casing part 5 with the substance carrier 17 lowered and the substance 3 thus completely accommodated in the protective sheath 18. The free end face of the moving part 19 lying opposite the opening region of the sheath section 21 preferably closes with the plane produced by the allocated end edge surface of the casing part wall 8 in the region of the passage opening 7.

The end edge of the moving part 19 or the protective sheath 18 enveloping the opening through which the substance 3 passes preferably pushes against the end edge surface of the cap wall 10 facing the latter. This position is preferably stop limited by having the cap part side shoulder 14 abut against the casing part side collar 9.

The selected assembled length of the protective cap 4 (length b) and device part 2 or protective sheath 18 (length c) is larger than the length a of the casing part 5 likewise viewed in the direction of extension of the rotational axis x, thereby yielding a projecting position of the diameter-reduced cap section over the passage opening 6 of the casing part 5 in the previously described position. The projection d can measure roughly one twentieth of the length a of the casing part 5.

In this position, the device part 2 is frictionally mounted in the casing part 5. To this end, the device part in the exemplary embodiment shown has peripheral enlargements 26 arranged in the region of the handling section 20, distributed around the periphery on the outside of the wall. These can be designed as pan head-shaped radial projections. In addition, for example, three such projections uniformly distributed over the periphery can be provided.

Figure 6:
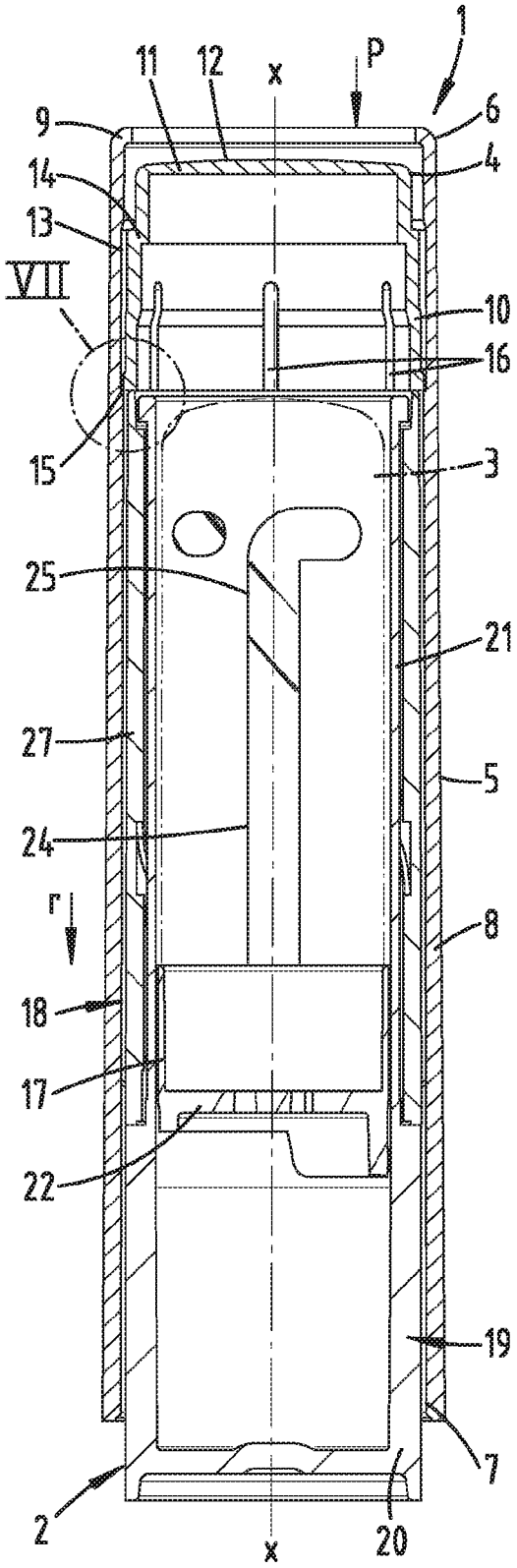
FIG. 6 is the section according to line VI-VI on FIG. 3.
Figure 7:
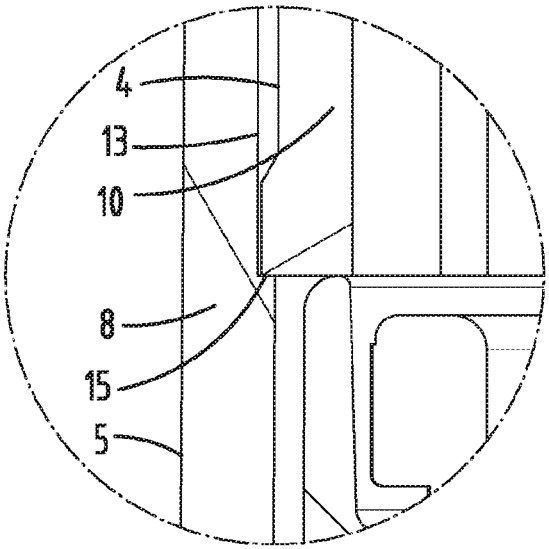
Figure 8:
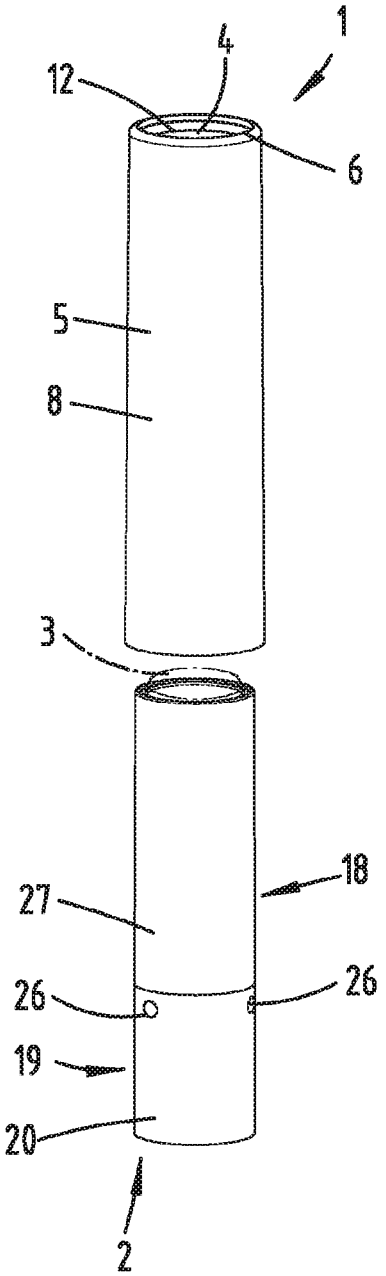
FIG. 8 is a perspective view of the device after removing the device part having the substance from a casing part of the device.
Figure 9:
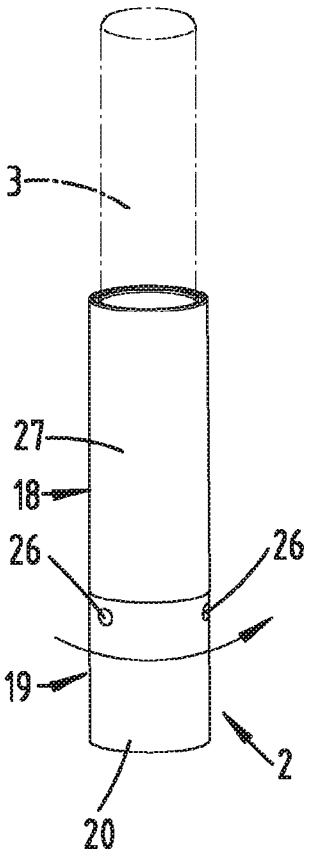
FIG. 9 is a perspective view of the device part having the substance when displacing the substance into a use position.
Figure 10:
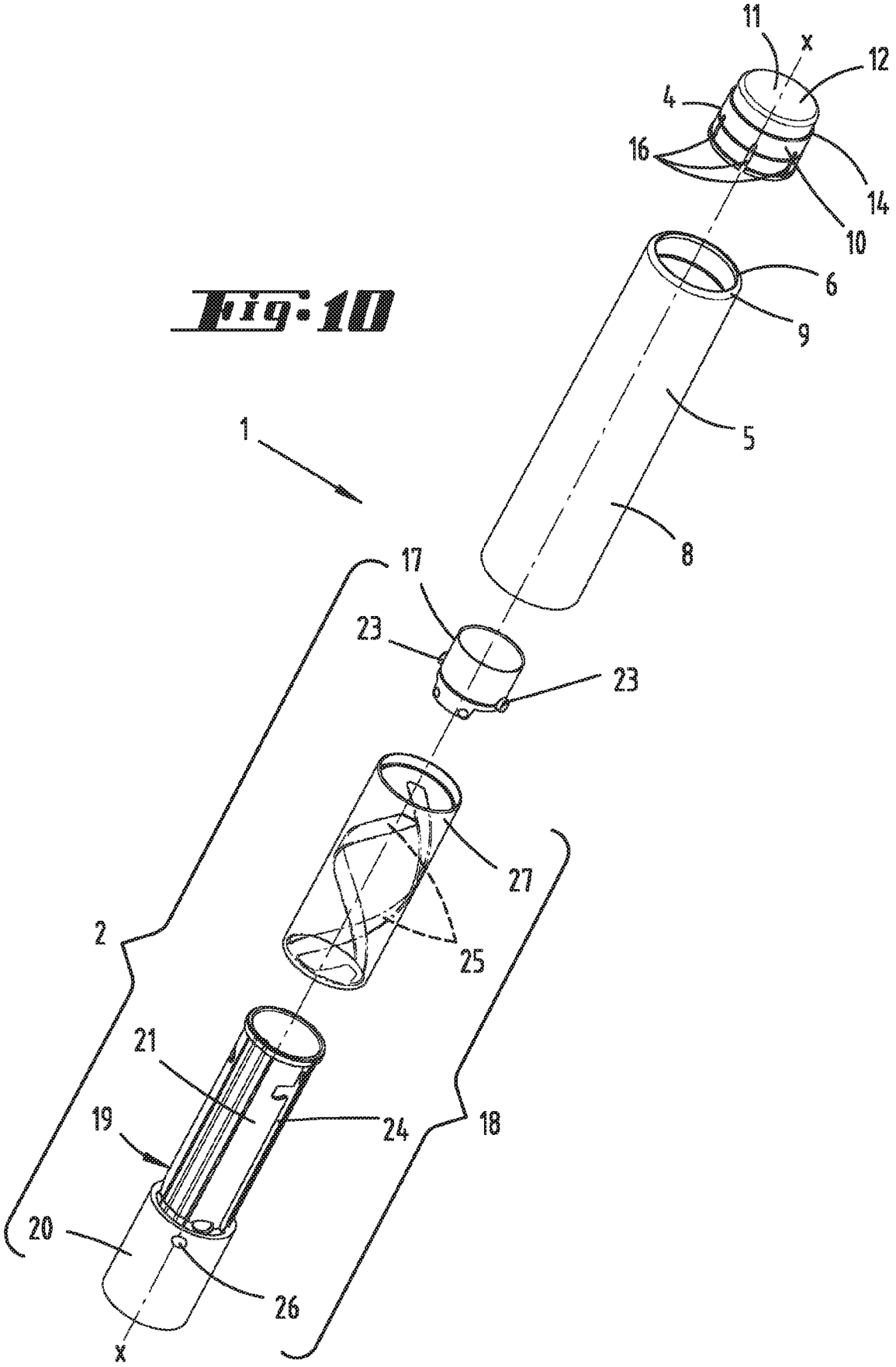
FIG. 10 is a perspective, exploded view of the device.

In order to apply the transferable substance 3, the device part 2 must be removed from the casing part 5. However, the latter is completely accommodated in the casing part 5 in the non-use state. Accordingly, removing the device part 2 requires preparation that involves displacing the protective cap 4 in the displacement direction r along the rotational axis x. Pressing the activating surface 12 (arrow P) displaces the protective cap 4 in the direction toward the interior of the casing part 5, accompanied by a sliding displacement of the device part 2 by the same distance. The protective cap 4 can be displaced until the free peripheral edge of the cap wall 10 hits the stop shoulder 15 in the interior region of the casing part wall 8, wherein the cap cover 11 in this position can extend below the opening plane of the passage opening 6 (see FIG. 6).

The opposite end of the device part 2 in the region of the handling section 20 plunges by the same distance over the passage opening 7 of the casing part 5 over which the protective cap 4 is displaced. Hereinafter, it would make sense to have a gripping section for completely removing the device part 2.

The device part 2 can also be moved by means of this manual shifting displacement into a position in which the frictional connection between the peripheral enlargements 26 and interior surface of the casing part wall 8 is released, so that the device part 2 might slide out of the 5 on its own.

When inserting the device part 2 back into the casing part 5, the accompanying shifting displacement displaces the protective cap 4 back into the stop-limited initial position, which makes it possible to completely accommodate the device part 2 in the casing part 5.

The above statements serve to explain the inventions encompassed as a whole by the application, which also each independently further develop the prior art at least by virtue of the following feature combinations, specifically:

A device, characterized in that the protective sheath 18 and protective cap 4 are accommodated in a casing part 5, and the protective cap 4 and protective sheath 18 can be shifted in a displacement direction r in the casing part 5, that the casing part. 5 has passage openings 6 and 7 at its opposite ends as viewed in the displacement direction r, and that the protective cap 4 is connected with the casing part 5 so that it can move in the displacement direction r, but is captive.

A device, characterized in that a combined length b and c of the protective sheath 18 connected with the protective cap 4 is larger than the length a of the casing part 5 in the displacement direction r.

A device, characterized in that the casing part 5 is designed as a cylinder.

A device, characterized in that the protective sheath. 18 has a moving part 19 for the substance 3.

A device, characterized in that the protective sheath 18 has a peripheral enlargement 26 over a portion of its length for a frictional interaction with an inner surface of the casing part 5.

A device, characterized in that the peripheral enlargement is formed on the moving part 19.

All disclosed features (whether taken individually or in combination with each other) are essential to the invention. The disclosure of the invention hereby also completely incorporates the disclosed content of the accompanying/attached priority documents (copy of prior application), including for the purpose of also incorporating features from these documents into the claims of the present application.

The features in the subclaims characterize independent inventive further developments of prior art, in particular so as to introduce partial applications based upon these claims.

REFERENCE LIST

1 Device
2 Device part
3 Substance
4 Protective cap
5 Casing part
6 Passage opening
7 Passage opening
8 Casing part wall
9 Collar
10 Cap wall
11 Cap cover
12 Activating surface
13 Region
14 Shoulder
15 Stop shoulder
16 Cutout
17 Substance carrier
18 Protective sheath
19 Moving part
20 Handling part
21 Sheath section
22 Carrier floor
23 Pin
24 Longitudinal slit
25 Control groove
26 Peripheral enlargement
27 Counter-holder cylinder
P Arrow
a Length
b Length
c Length
d Projecting substance
r Displacement direction
x Rotational axis

The invention claimed is:

1. A device (1) for applying a transferable substance (3) in stick form, with a substance carrier (17) and a protective sheath (18) for the substance carrier (17), wherein the substance carrier (17) is configured to be shifted relative to the protective sheath (18) in order to shift a free end region of the substance (3) into a free, projecting position, and further with a protective cap (4) for covering a free end region of the substance (3) in a non-use state, wherein the protective sheath (18) and protective cap (4) are accommodated in a casing part (5), and the protective cap (4) and protective sheath (18) are configured to be shifted in a displacement direction (r) in the casing part (5), wherein the casing part (5) has passage openings (6 and 7) at its opposite ends as viewed in the displacement direction (r), and wherein the protective cap (4) is connected with the casing part (5) so that the protective cap can move in the displacement direction (r), wherein the protective cap is held captive to the casing part, wherein the protective sheath (18) has a peripheral enlargement (26) over a portion of its length for a frictional interaction with an inner surface of the casing part (5), wherein the protective sheath (18) has a moving part (19) for the substance (3) and wherein the peripheral enlargement is formed on the moving part (19).

2. The device according to claim 1, wherein a combined length (b and c) of the protective sheath (18) connected with the protective cap (4) is larger than the length (a) of the casing part (5) in the displacement direction (r).

3. The device according to claim 1, wherein the casing part (5) is designed as a cylinder.

4. A device (1) for applying a transferable substance (3) in stick form, with a substance carrier (17) and a protective sheath (18) for the substance carrier (17), wherein the substance carrier (17) is configured to be shifted relative to the protective sheath (18) in order to shift a free end region of the substance (3) into a free, projecting position, and further with a protective cap (4) for covering a free end region of the substance (3) in a non-use state, wherein the protective sheath (18) and protective cap (4) are accommodated in a casing part (5), and the protective cap (4) and protective sheath (18) are configured to be shifted in a displacement direction (r) in the casing part (5), wherein the casing part (5) has passage openings (6 and 7) at its opposite ends as viewed in the displacement direction (r), and wherein the protective cap (4) is connected with the casing part (5) so that the protective cap can move in the displacement direction (r), wherein the protective cap is held captive to the casing part, wherein an edge of the protective sheath (18) pushes against an edge of a cap wall of the protective cap (4) allowing for a transfer of a movement of the cap (4) into a movement of the protective sheath (19), wherein the protective sheath (18) has a peripheral enlargement (26) over a portion of its length for a frictional interaction with an inner surface of the casing part (5).

5. The device according to claim 4, wherein a combined length (b and c) of the protective sheath (18) connected with the protective cap (4) is larger than the length (a) of the casing part (5) in the displacement direction (r).

6. The device according to claim 4, wherein the casing part (5) is designed as a cylinder.

7. The device according to claim 4, wherein the protective sheath (18) has a moving part (19) for the substance (3).

8. The device according to claim 7, wherein the peripheral enlargement is formed on the moving part (19).

* * * * *